United States Patent [19]

Conroy et al.

[11] 4,401,255

[45] Aug. 30, 1983

[54] DISTRIBUTOR PACK CARTON

[75] Inventors: Betty A. Conroy, Ridgefield, N.J.; William M. Brown, Darien, Conn.; Patrick S. Maio, Ridgewood, N.J.

[73] Assignee: Federal Paper Board Co., Inc., Montvale, N.J.

[21] Appl. No.: 289,728

[22] Filed: Aug. 3, 1981

[51] Int. Cl.[3] ..... B65D 5/72

[52] U.S. Cl. ..... 229/37 R; 229/17 B; 229/7 R; 229/43

[58] Field of Search ..... 229/37 R, 17 B, 7 R, 229/43, 28 BC; 206/45, 13

[56] References Cited

U.S. PATENT DOCUMENTS

| | | | |
|---|---|---|---|
| 1,852,527 | 4/1952 | King | 229/39 R |
| 2,375,631 | 5/1945 | De Villard | 229/28 BC |
| 2,448,401 | 8/1948 | Stone | 229/39 R |
| 2,753,102 | 7/1956 | Paige | 206/499 |
| 3,625,411 | 12/1971 | Cote | 229/37 R |

*Primary Examiner*—Herbert F. Ross

*Attorney, Agent, or Firm*—FitzGibbon, Roehrig, Greenawalt & Stone

[57] ABSTRACT

A sleeve-type or tube container wherein an open end of the sleeve may be at least partially closed by closure portions formed from integral portions of the container sleeve or body, and including a strap hanger or flex extending across and forming the sleeve bottom. The strap hanger or flex is formed from the sleeve body and suspended to lie parallel to and extend downwardly along the inner surface of the sleeve side walls from which it is formed.

16 Claims, 19 Drawing Figures

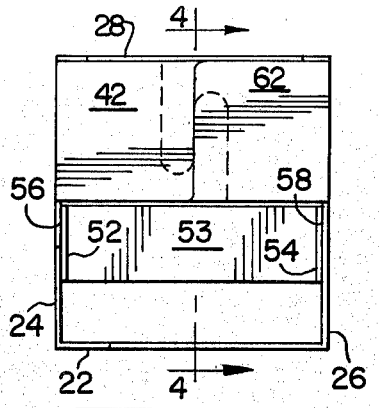
FIG. 3
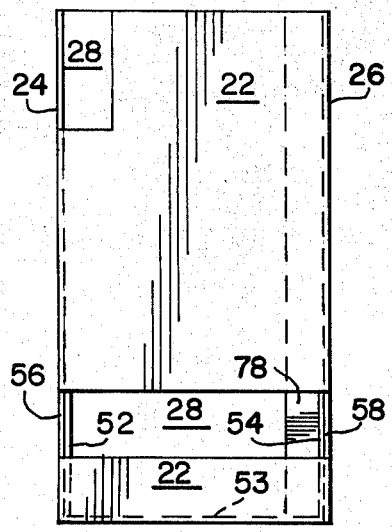
FIG. 5
FIG. 7
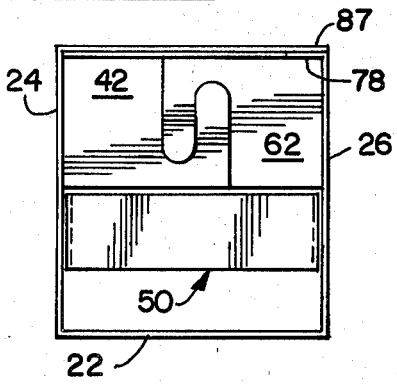
FIG. 4
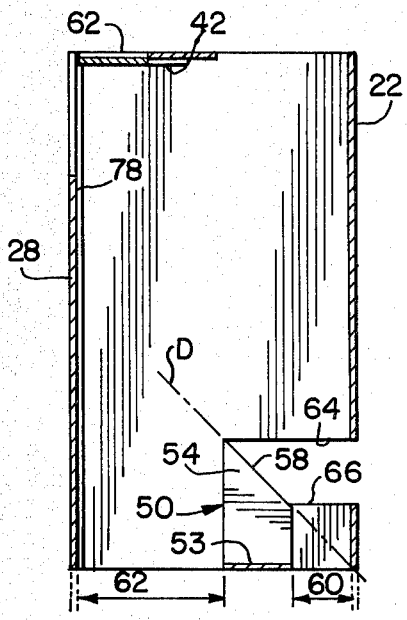
FIG. 6
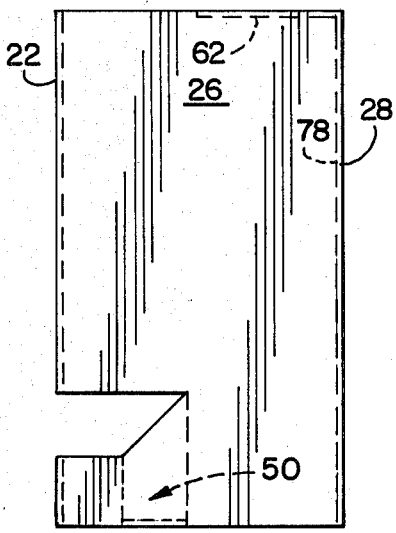

FIG. 9
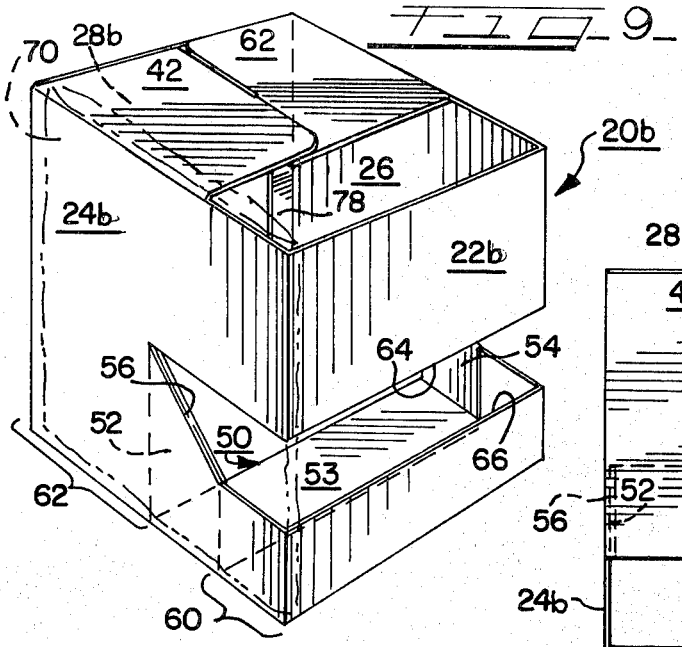
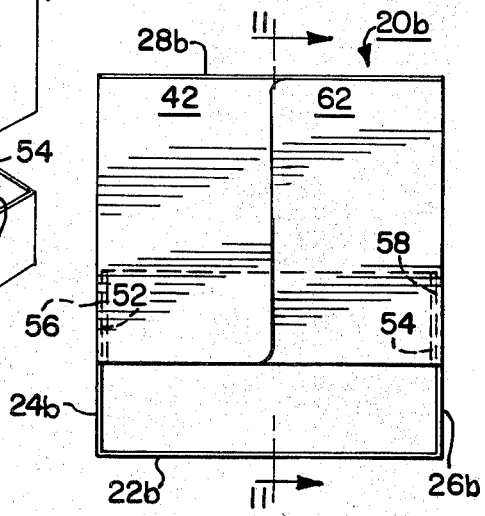
FIG. 10
FIG. 11
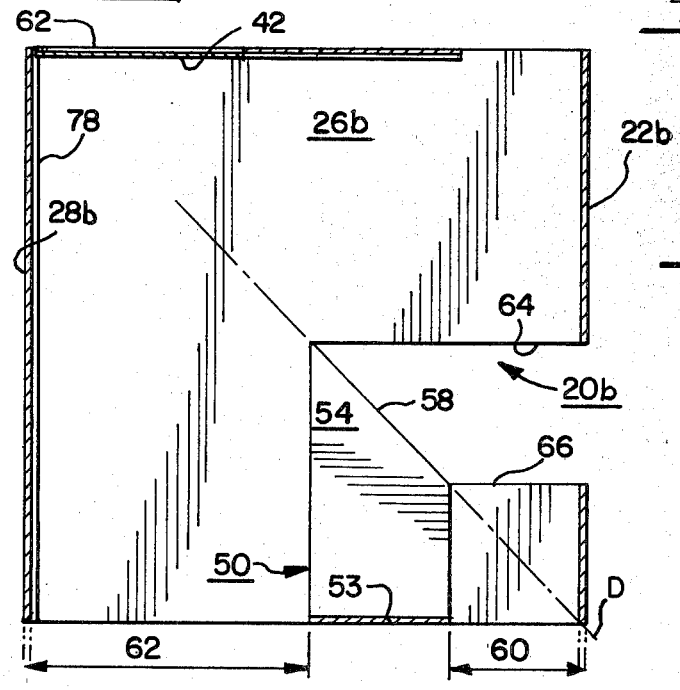
FIG. 8
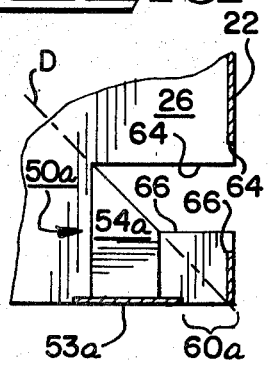

DISTRIBUTOR PACK CARTON

BACKGROUND OF THE INVENTION

This invention relates in general to folding cartons and, in particular, to a folding carton which is adapted to be used for containing and packaging smaller individually pre-packaged items within the container.

More specifically, but without restriction to the particular uses which are shown and described, this invention relates to a carton formed from an open-ended tube in which the closures thereof may be formed from an integral portion of the tube body. Portions of the packaged items contained within the carton may be observed through the carton to determine such things, for example, as size, color or "UPC" coding.

In the retail trade, it is quite common to merchandise such articles as pre-packaged hoisery, smoking tobacco, office supplies, dry goods, drug supplies and other sundry items in individual packages to be purchased by a retail customer. Such items are frequently purchased by a retailer from a wholesale distributor in smaller quantities than in large case lots containing a greater quantity of these items. Therefore, it has become desirable to provide an intermediate packing container or carton within such larger packing cases or shipping containers. Such intermediate packing containers or cartons are referred to in the trade as a "distributor pack" and contain a smaller quantity of the individually pre-packaged consumer or retail items.

Distributor packs used in this manner are especially useful for packing irregular shaped individual items. Such items, for example, as blister-packed tape dispensers are difficult to package as individual items in case lot quantities due to their irregular shape. Therefore, smaller quantites of such items are frequently packaged in a container, such as a distributor pack, which is used as an intermediate packer in a larger case to facilitate orderly packing and shipping of such items in case lot quantites. Such distributor pack cartons may also be utilized to conveniently pre-package smaller quantites of individually packaged items by, for example, size or color. In this manner less than case lot quantities of a particular size or color of an item may be economically packaged, or a case lot quantity containing a mixed assortment of items may be packed eliminating the necessity of case-lot purchases of each size or color.

In order to perform these functions, a distributor pack must provide an economical packaging medium for distribution of moderate quantities of individual pre-packaged items in order to minimize the additional packaging cost to the product manufacturer. In addition, such packaging must be sufficiently strong to provide adequate protection for the individual pre-packaged products contained therein, and to prevent loss or damage to the individual pre-packaged items or their package.

The present invention provides an economical distributor pack carton which does not require the addition of paperboard closure devices to close the bottom of the carton, or require the use of two-piece telescoping cartons as heretofore necessary. The distributor pack carton of the present invention has the bottom closure thereof formed from an integral portion of the carton body and protects individual packages within the carton against damage.

The carton body is formed as an open end tube which may be readily constructed using high speed gluing techniques since the tube is formed by single-line strip gluing along a single straight edge. In addition, the bottom closure of the open ended tube may be quickly and conveniently set up, to enable the distributor pack to be quickly filled with individual pre-packaged items at a minimum of time and expense. The open ended tube construction having the bottom closure formed from an integral portion of the tube body eliminates the necessity of complex packaging assembled about an array of individual consumer packaged goods, or expensive and complex operations requiring on-site gluing or the like.

In one embodiment of the invention, predetermined portions of the panels from which the open end tube carton is formed are removed to display a portion of the individual pre-packaged items to be contained within the pack. The provision of such openings in the distributor pack carton permits the ready determination of such things, for example, as size, quantity, color, price, date or "UPC" coding on the individual packages. In addition, providing these openings in the body of one carton allows two such distributor pack cartons to be nested together and formed from a single standard sheet of paperboard. Since standard sheets of paperboard are customarily formed in a square or rectangular configuration, individual carton blanks may be inter-nested or laid out on the standard sheet of paperboard in complementary form to provide maximum utilization of the paperboard in forming the carton blank. The formation of a top closure of one of the open ended tubes from the paperboard material removed to form the openings in the panels of the other complementary inter-nested carton blank permits the greatest efficiency and utilization of the paperboard stock from which these cartons are formed and substantially eliminates wasted paperboard.

SUMMARY OF THE INVENTION

It is therefore, an object of this invention to improve folding cartons for containing smaller individual packed items therein.

Another object of this invention is to display a portion of the individual packages contained within a folding carton.

A further object of this invention is to utilize a carton body to integrally form closure devices on each end of the carton for securely containing materials placed in the carton.

Still another object of this invention is to utilize a carton body to form a partial closure of the carton bottom that will retain individual packages contained within the carton and prevent the individual packages from being damaged by falling below the bottom of the carton.

A still further object of this invention is to economically utilize a blank of paperboard material from which a carton is to be constructed.

Yet another object of this invention is to display one or more portions of individual packages contained within the carton.

These and other objects are attained in accordance with the present invention wherein there is provided a sleeve-type or tube container wherein the open ends of the sleeve may be at least partially closed by closure portions integrally formed from the container sleeve or body, and including a strap hanger or flex extending across and forming the sleeve bottom. The strap hanger or flex is formed from the sleeve body and suspended to lie parallel to and extend downwardly along the inner surface of the sleeve side walls from which it is formed.

DESCRIPTION OF THE DRAWINGS

Further objects of the invention together with additional features contributing thereto and advantages accruing therefrom will be apparent from the following description of preferred embodiments of the invention which are shown in the accompanying drawings with like reference numerals indicating corresponding parts throughout, wherein:

FIG. 3 is a top plan view of the carton illustrated in FIG. 1;

FIG. 4 is a vertical sectional view of the carton shown in FIGS. 1 and 3 taken along lines 4—4 of FIG. 3;

FIG. 5 is a front view of the folding carton of FIG. 1;

FIG. 6 is a side elevational view of the carton illustrated in FIG. 1;

FIG. 7 is a bottom plan view of the carton of FIG. 1;

FIG. 8 is a fragmentary sectional view of a modification to the carton of the invention which may be incorporated into the embodiment shown in FIGS. 1–7 to modify the strap hanger employed therein;

FIG. 9 is a perspective view of another embodiment of a folding carton made in accordance with the invention and showing, in phantom lines, an envelope-type package contained therein;

FIG. 10 is a top plan view of the carton illustrated in FIG. 9;

FIG. 11 is an enlarged vertical sectional view of the carton shown in FIGS. 9 and 10 taken along lines 11—11 of FIG. 10;

DESCRIPTION OF THE PREFERRED EMBODIMENTS

Figure 2:
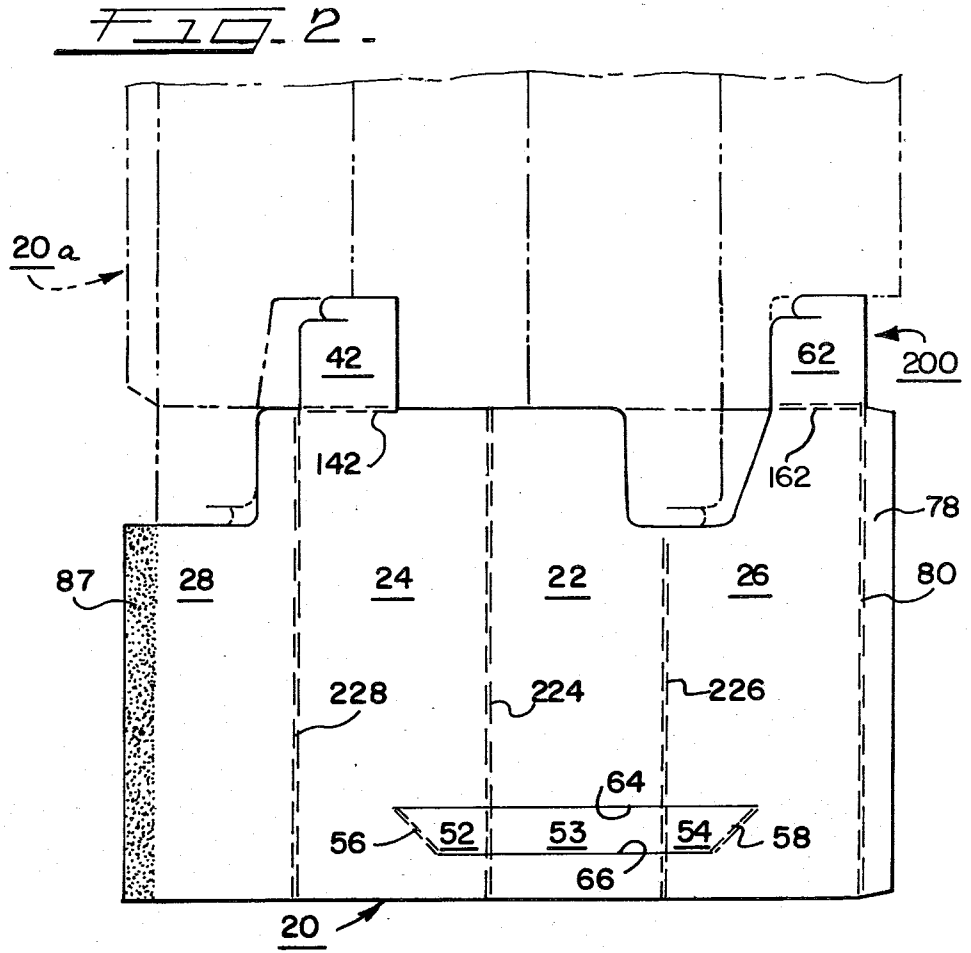
FIG. 2 is a plan view of a paperboard blank to illustrate the manner in which a pair of carton blanks, from which the carton of the invention may be formed, are inter-nested with one carton in solid lines and an adjacent carton in phantom lines to illustrate the economical layout of the paperboard blank.

While it will be understood that the invention has various embodiments, and cartons constructed in accordance therewith are capable of various uses and of being disposed in different positions when in use, for convenience of illustration in the following description and in the claims the orientation of a carton will be described such that the carton bottom, which supports the contents within the carton, is partially closed by a flex hanger or hanger strap which lies generally horizontal. The carton top is above and opposite the carton bottom, and may be partially closed by closeable flaps, with the carton sidewalls extending vertically therebetween.

Referring now to the embodiment of the invention as illustrated in FIGS. 1–8, there is shown a distributor pack carton 20 comprising a four-side rectangular carton having a front wall 22, a pair of opposed side walls 24 and 26, and a rear wall 28. A pair of closure flaps 42 and 62 extend from the upper portion of the side walls 24 and 26, respectively, and may be interconnected to each other by cooperating notched-end or interlocking tab portions in a manner that is known to those skilled in the art. The bottom of the carton 20 is partially closed by means of a bottom forming flex hanger or hanger strap 50 which provides a partial closure of the carton bottom and a support for the contents contained within the carton, such as individual packages 70 shown in phantom in FIG. 1.

The bottom of the carton 20 is partially closed by the strap hanger 50 which extends between the two sidewalls 24 and 26. The flex or strap hanger 50 includes a pair of suspension straps or hangers 52 and 54, and a bottom support strap 53, all of which are formed from the body of the carton 20. The straps 52 and 54 are each formed from the sidewalls 24 and 26, respectively, while the bottom support strap 53 is formed from parallel horizontally extending cuts 64 and 66 which are formed in the carton blank 20. The ends of these two cut lines 64 and 66 are joined by diagonally extending score lines 56 and 58, formed in side walls 24 and 26, respectively, to form a pair of fold lines about which the cut portion of the side walls 24 and 26 may be folded to form the hangers 52 and 54. These score lines 56 and 58 extend diagonally toward the bottom corner of the carton where the front wall 22 and the adjoining side walls 24 and 26 meet.

The portion of the carton 20 which is cut from the side walls 24 and 26, and front wall 22, to form the flex hanger 50 provides a window portion through which the contents contained within the carton 20 may be seen or portions thereof displayed to indicate such things as color, size, quantity or data coding. The flex hanger 50 divides the open bottom of the carton 20 into a pair of spaced open areas 60 and 62, and forms a partial closure of the open bottom from an integral portion of the carton structure. As can best be illustrated with reference to FIGS. 4 and 8, the position of the bottom support strap 53 of the flex hanger in relation to the open bottom of the carton 20, and the relative positioning or sizes of the open areas 60 and 62 of the carton bottom, can be varied by the lateral spacing of the cut lines 64 and 66, and the extent to which the cut lines extend across the side walls 24 and 26. As long as the fold lines 56 and 58 are formed along a line "D" extending diagonally from the bottom corner juncture of the sidewalls and the front wall, the bottom support strap 53 will be positioned at the carton bottom when the carton 20 is erected.

The higher cut lines 64 and 66 are formed from the bottom of walls 22, 24 and 26, the further the cut lines will extend across the side walls 24 and 26 to reach the diagonal line "D" and, therefore, the further the flex hanger 50 will be spaced from the front wall 22 and closer to the rear wall 28. Shorter transverse cuts across the side walls 24 and 26 will result in the flex hanger 50 being positioned closer to the front wall 22 as log as the fold lines 56 and 58 lie along line "D". As the fold lines are formed along a parallel diagonal line passing either above or below this juncture point, the bottom strap 53 will be positioned above or below the carton bottom accordingly. Thereby, the length of the cut lines 64 and 66, as well as their vertical positioning relative to the carton bottom, may accordingly be varied to suit the carton 20 for a desired purpose.

In addition, the width of the flex hanger 50 may be varied by changing the lateral spacing between the two parallel cut lines 64 and 66 which will change the width of the hangers 52 and 54, as well as the bottom support strap 53. As shown in the alternative embodiment of FIG. 8, the lateral spacing between the two parallel cuts 64 and 66 can also be different for that portion of the cuts made in the front wall 22, than that portion of the cuts made in the two side walls 24 and 26. Such variation between the lateral spacings of the cut lines 64 and 66, relative to these panels, can be utilized to form a flex hanger 50*a* wherein the bottom support strap 53*a* is of greater—but may be formed as a lesser—width than the hangers 52*a* and 54*a* to thereby vary the portion of the open bottom of the carton which would be closed by the flex hanger 50*a* or to increase the contact or support are of the strap. This change also permits variation of the size of the window portions formed in the front wall 22 and the size of the spaced open areas 60*a* and 62*a*.

Figure 16:
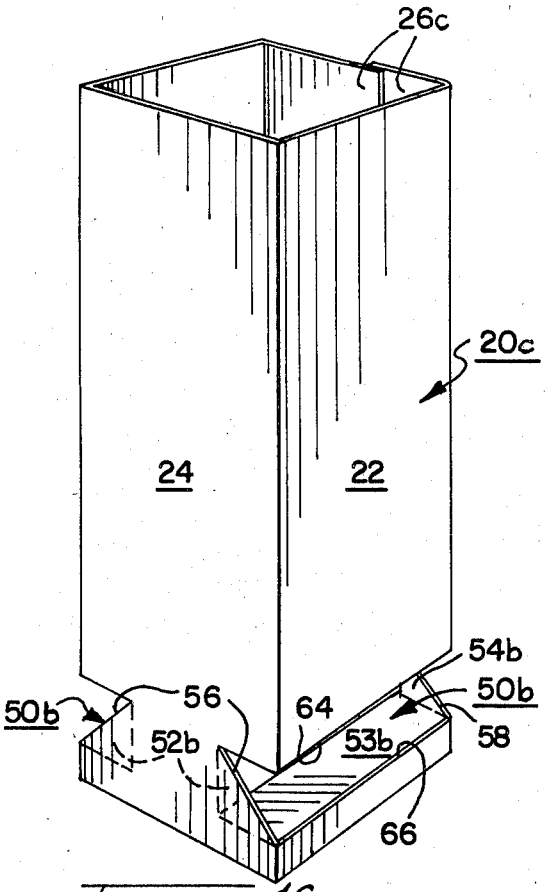
FIG. 16 is a perspective view of another embodiment of the container made in accordance with the invention which utilizes a pair of spaced apart strap hangers.
Figure 17:
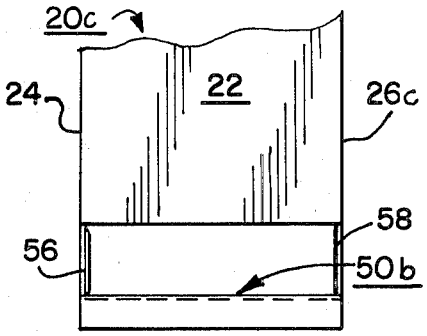
FIG. 17 is a partial front view of the folding carton embodiment illustrated in FIG. 16 to better illustrate the lower portion thereof.
Figure 18:
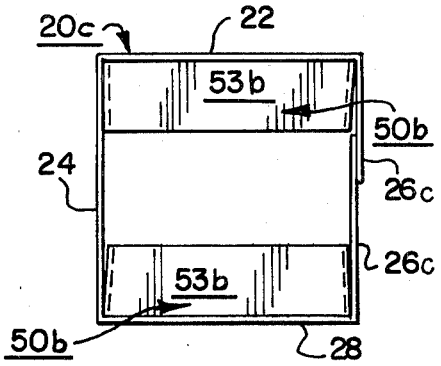
FIG. 18 is a bottom plan view of the carton illustrated in FIGS. 16 and 17.

Referring now to the top of the carton 20, the top closure flaps 42 and 62 are spaced from the front wall 22 in order to provide a top opening for viewing the contents contained within the carton. The size of the closure flaps 42 and 62 and, therefore, the opening at the top of the carton 20, may be varied depending upon the intended use of the carton, or the nature of the individual packages 70 to be contained therein. These individual packages 70, which are placed in the distributor pack or carton 20 by the manufacturer, extend across the flex hanger 50 and are supported thereby with the bottom edges of the respective individual packages 70 being protected within the confines of the carton. The windows defined in the side wall 24 and 26, and the front wall 22, which are created by formation of the strap hanger 50, and the opening at the top of the carton 20 provide a visual display of the individual packages 70 contained within the carton. While a pair of interlocking tabs 42 and 62 are illustrated, the top of the carton 20 could be completely open, as shown in FIGS. 16 and 18, or closed by a conventional tuck top arrangement.

Figure 1:
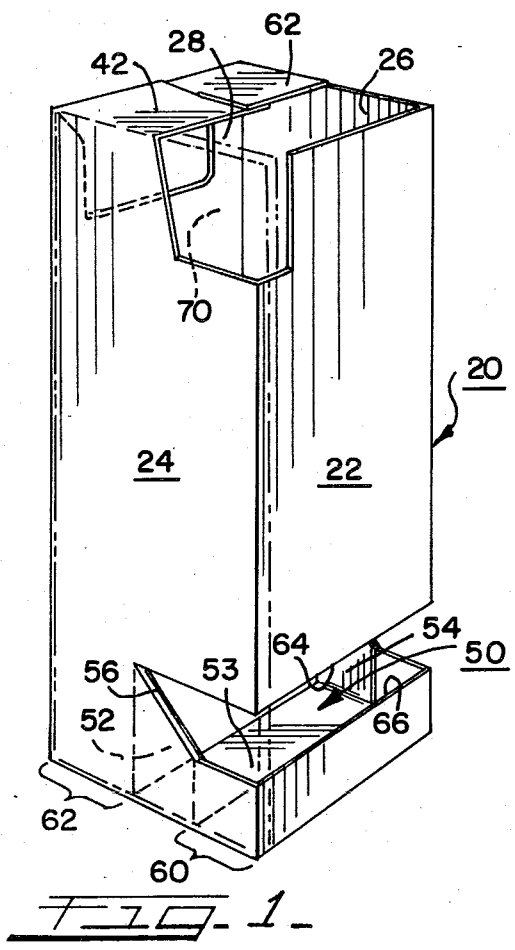
FIG. 1 is a perspective view of a folding carton made in accordance with the invention and showing, in phantom lines, an envelope-type package contained therein.

As best shown in FIGS. 1 and 2, an upper-right corner portion of sidewall 24 and upper-left corner portion of front wall 22 are removed to display indicia such as the "UPC" coding on individual packages 70 contained within the distributor pack 20. In addition, a center portion of the upper end of panel 28 is also removed permitting a portion of the contents within the container 20 to be exposed to show such things as quantity, size, color, etc. of the items contained in the individual packages 70.

While the removal of these portions of sidewalls 24, front wall 22, and rear wall 28 permits ready determination of the carton contents, it also provides another important advantage in the economical use of the paperboard blank 200 from which the carton 20 is formed. In the layout of the carton blank 20 on the paperboard 200, the top closure flaps 42 and 62 of one carton blank 20 are formed from those portions of the side, front and rear walls 24, 22 and 28, respectively, removed from another nested or complementary carton blank 20*a*. In this manner less paperboard becomes scrap and the use of paperboard blanks 200 is extremely efficient. Not only can the closures for the carton tube be formed from integral portions of the carton body, but the carton blanks themselves may be efficiently formed from a standard sheet of paperboard 200 with very little waste.

Referring to FIG. 2, there is shown a standard paperboard blank 200 having a layout scheme to illustrate how a pair of cartons 20 and 20*a* may be constructed therefrom. One carton 20, in an unerected form, will be referred to in detail and is shown in solid lines; its counterpart 20*a* is shown in phantom lines. The carton 20 includes front wall 22, the two side walls 24 and 26, and rear wall 28. Fold lines 224, 226 and 228 are formed in the blank 200 to facilitate folding the paperboard panels relative to each other to facilitate erection of the carton 20. A flap 78 is formed from the same paperboard panel as sidewall 26 by a single score fold line 80 such that the flap 78 extends outwardly therefrom to overlie a margin area 87 of the rear wall panel 28. When erecting the carton 20, the flap 78 is secured to the rear wall 28. Fold lines 224, 226 and 228 are formed in the blank 200 to facilitate folding the paperboard panels relative to each other to facilitate erection of the carton 20. A flap 78 is formed from the same paperboard panel as sidewall 26 by a single score fold line 80 such that the flap 78 extends outwardly therefrom to overlie a margin area 87 of the rear wall panel 28. When erecting the carton 20, the flap 78 is secured to the rear wall 28 by an adhesive or other means as is known to those skilled in the art. As previously discussed, the two cut lines 64 and 66 are joined by diagonal fold lines 56 and 58 which enable the flex hanger 50 to be formed from the carton 20 body when the carton is erected.

The top closures 42 and 62 are each formed from the same paperboard panel as sidewalls 24 and 26, respectively, by single score fold lines 142 and 162. The top closures 42 and 62 have tabs which interlock to form a partial closure of the open end of the carton 20 when erected by folding about the fold lines 142 and 162, respectively. As previously discussed, the distance between the respective fold lines 224 and 226 and the respective forward edge of the top closure panels 42 and 62 will determine the size of the opening at the top of the carton 20.

As previously noted, a second carton blank 20*a* is shown in phantom lines in FIG. 2. This layout provides a second carton 20*a* from the standard paperboard blank 200 by laying out cut and score lines similar to the carton blank of carton 20, but positioned in mirror-like image or offset form with respect to the patterns formed for the carton blank 20. Accordingly, further description of the carton blank 20*a* is not considered necessary, it being understood that it is a distinct advantage of the invention that the two blanks 20 and 20*a* may be made in a generally inter-nested layout relation to provide economy in manufacturing two cartons 20 and 20*a* from a single standard paperboard blank 200.

Referring now to the erection of the carton 20, the marginal area 87 of the rear wall forming panel 28 may have an adhesive substance applied thereto, or the adhesive may be applied to the flap 78 which is contiguous with the sidewall 26 or both. Since the carton blanks 20 and 20*a* are inter-nested in the manner previously discussed, adhesive application is also simplified. High speed straight path application of adhesive on both carton blanks 20 and 20*a* is greatly enhanced by such a layout. After an adhesive has been so applied, the carton is folded about the score or fold lines 224, 226 and 228 such that the flap 78 overlaps the marginal area 87. At this point the carton blank has been formed into a sleeve or tube having a pair of open ends.

The closure for the bottom of the tube—which supports and retains individual packages within the carton 20—is formed from integral portions of the tube by pushing inwardly on the area defined between cut lines 64 and 66, and diagonal fold lines 56 and 58 to create the flex hanger 50. The bottom support strap 53 is folded inwardly on the fold lines 224 and 226 to form the bottom of the carton 20, and the hangers 52 and 54 are folded down and inwardly about the fold lines 56 and 58, respectively, to form vertical hangers to suspend the support strap 53 in a position across the carton bottom to support individual packages within the carton. After the tube has been created and the flex strap bottom so formed, the contents—such as the individual packages 70—may be placed into the carton 20. The top of the carton is thereafter closed by interlocking the lock tabs of top closure flaps 42 and 62 to form a partial cover. The loaded distributor cartons 20 are then suitable for use as a shipping or packing carton with the contents contained within the carton being visible through the window created during formation of the flex hanger 50 and the partially open top and back of the carton.

Referring now to the embodiment illustrated by FIGS. 9 through 15, a carton 20*b* is constructed in a manner similar to that described with reference to the embodiment of FIGS. 1–8, but the carton walls 22*b*, 24*b*, 26*b* and 28*b* are constructed in a substantially square configuration. Carton 20*b* more completely encloses the individual packages contained within the container and may include a pair of large interlocking tabs 42 and 62, as shown, or the entire top may be closed as by a conventional tuck top closure. Depending upon the requirements for the use of the carton 20*b*, the upper end of the carton may even be completely open.

Figure 15:
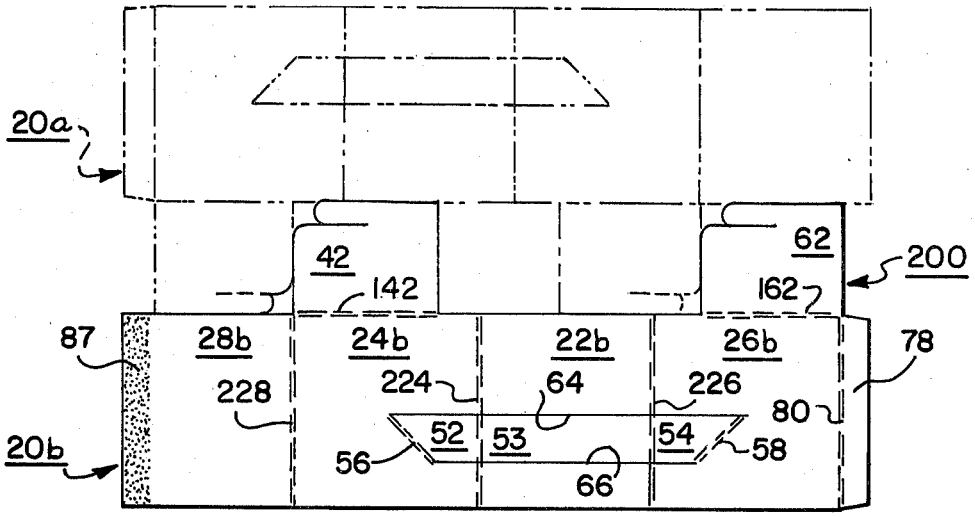
FIG. 15 is a plan view of a paperboard blank to illustrate an alternative manner in which a pair of carton blanks, from which the carton of the invention may be formed, are inter-nested with one carton in solid lines and an adjacent carton in phantom lines to illustrate another economical layout of the paperboard blank.
Figure 12:
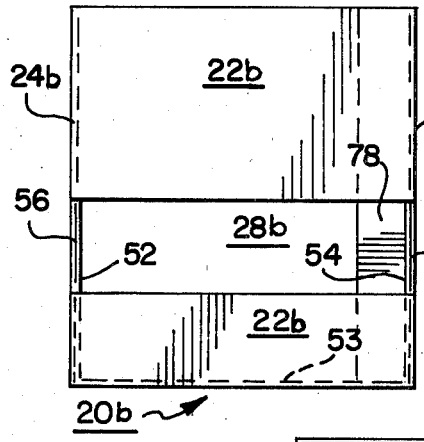
FIG. 12 is a front view of the folding carton of FIGS. 9–11.
Figure 13:
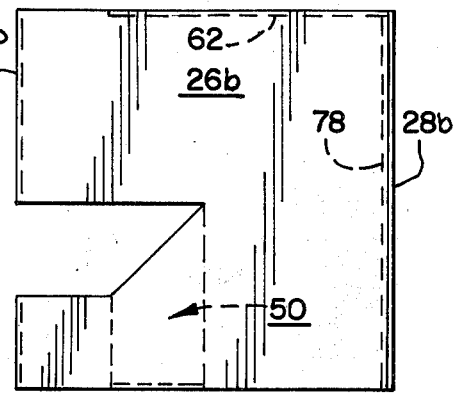
FIG. 13 is a side elevational view of the carton illustrated in FIGS. 9–12.
Figure 14:
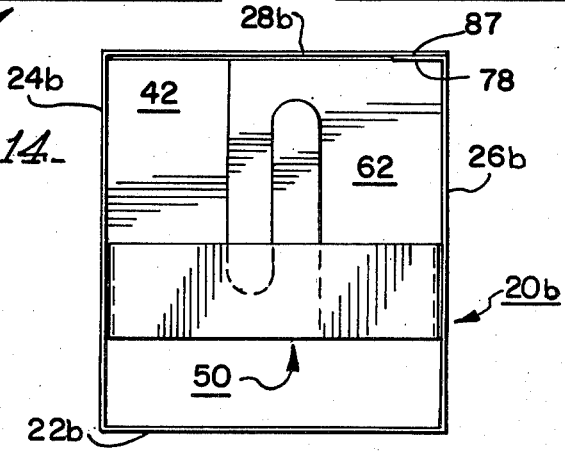
FIG. 14 is a bottom plan view of the carton of FIGS. 9–13.

As best shown in FIG. 15, in this embodiment two carton blanks may again be formed from a standard or single paperboard blank 200. Since the walls 22*b*, 24*b*, 26*b* and 28*b* do not have portions removed, as in the previous embodiment, the closures 42 and 62 cannot be formed from the paperboard stock in the manner previously described. However, the panels forming the closures 42 and 62 of carton blanks 20*b* are positioned on the paperboard blank 200 between the closure forming panels of a second carton blank 20*a* to make the most efficient use of the paperboard blank and minimize paperboard loss.

Referring now to the embodiment illustrated in FIGS. 16–19, a carton 20*c* is formed as previously described except that two strap or flex hangers 50*b* of a different form are created from the carton body 20*c*, and one of the sidewalls 26*c* is formed in two portions. In this embodiment a flex hanger 50*b* is created on opposed sides of carton 20*c* from both the front panel 22 and the rear panel 28 in a form somewhat modified from that previously described. The strap or flex hanger 50*b* is created with the diagonal fold lines 56 and 58 extending from a position directly in contact with the fold lines 224 and 226 for the front flex 50*b*, and from fold lines 228 and 226 for the rear flex 50*b*. In this manner the bottom strap 53*b* of the flex hanger does not extend vertically downward to the open bottom of the carton 20*c*, but forms a support at the same elevation as the cut line 66. When the flex hanger 50*b* is formed in this manner, line 66 may be formed as a score or fold line, instead of being cut through the paperboard blank 200 from which the carton 20*c* is formed. In this embodiment, for illustrative purposes, the top of the carton 20*c* is completely open.

In the assembly of carton 20*c*, the flex hanger 50*b* is formed by folding the portion of the paperboard blank defined by the lines 64, 66, 56 and 58 inwardly. The hanger straps 52*b* and 54*b* will extend vertically downward and the bottom support strap 53*b* may be either hingedly supported from the front wall 22 or positioned normal thereto in contact with the front wall, depending upon line 66 being formed as a fold or cut line, respectively. The rear wall 28 and the flex hanger 50*b* associated therewith are constructed in the same manner so that the carton 20*c* is provided with two support hangers 53*b* for retaining the contents within the carton. In this manner portions of the individual packages contained within the carton 20*c* may be supported on both sides which may be desirable in certain applications. While the bottom edges of individual packages contained in such cartons will be exposed in this embodiment, the bottom edges of the individual packages will still be carried above the open carton bottom, and protected by the confines of the carton and the increased package stability afforded by the use of the two flex hangers 50*b*.

Figure 19:
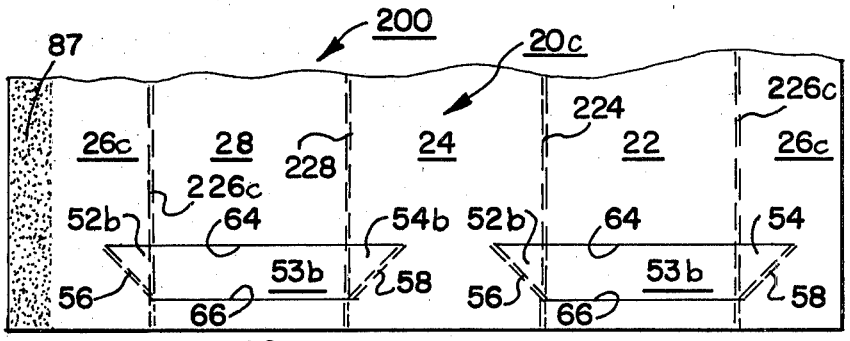
FIG. 19 is a plan view of a portion of a paperboard blank from which the folding carton illustrated in FIGS. 16–18 may be formed.

As best shown in FIG. 19, the paperboard blank 200 has two score or fold lines 226 in this embodiment which forms the sidewall 26 in two portions. One portion of sidewall 26*b* is contiguous with each of the front and rear walls 22 and 28, respectively. In this manner, when the carton 20*c* is erected the two portions of sidewall 26*c* are folded about the two fold or score lines 226*c* and extend in an overlapping relation so that the adhesive-coated marginal area 87 on one portion of sidewall 26*c* will be secured to the other portion of sidewall 26*c*. The complete sidewall 26*c* so formed when the carton tube is erected will thereby have the joinder along one side.

It will thus be seen that the present invention provides a novel economical folding carton having a number of advantages and characteristics including those pointed out above and others which are inherent in the invention. While preferred embodiments of the invention have been described by way of illustration, it is anticipated that changes and modifications to the described embodiments will occur to those skilled in the art and that such changes and modifications may be made without departing from the spirit of the invention or the scope of the appended claims.

What is claimed is:

1. A folding carton made from a pre-glued tube of paperboard or the like and adapted to receive therein a plurality of individually packaged articles, said carton including, in its erected condition and in a position of normal use, a pre-glued paperboard tube having four joined vertical walls including a front wall and a pair of opposed sidewalls, and a rear wall, cover means for forming a top closure for said carton, including top cover-forming flaps associated with said sidewalls of a reduced width in relation to the width of said sidewalls, and having one pair of flap edges thereof which lie parallel to and closely adjacent one of said carton walls and another pair of flap edges lying parallel to but spaced from an oppositely disposed carton sidewall to provide an opening for viewing the contents of said carton, said carton having a bottom closure in the form of a closure strap formed from a first wall of said pre-glued tube, and extending between opposed vertical walls of said tube, said bottom closure strap being positioned and supported by depending strap hangers attached to said closure strap, each strap hanger being formed from a vertical wall of said pre-glued tube other than said first wall and being joined to said wall at the upper end of said strap hanger along a fold line, said fold line permitting said strap and hangers to be folded out of the respective planes of said pre-glued tube formed by said joined vertical walls to provide support for articles within said tube and a contents-viewing opening in three sides of said tube.

2. A carton as defined in claim 1 wherein one of the said vertical walls includes a wall-forming panel and a securing tab panel, said tab panel being secured to and overlying a portion of one of the other carton walls.

3. A carton as defined in claim 1 wherein said closure strap is formed from the front wall of said carton and said strap hangers are formed from said sidewalls.

4. A carton as defined in claim 3 wherein said fold line extends diagonally across said sidewalls.

5. A folding carton as defined in claim 1 wherein said bottom closure strap lies in the same plane as the lower edges of said vertical walls.

6. A folding carton as defined in claim 1 wherein said bottom closure strap lies above the plane of the carton bottom and parallel thereto.

7. A folding carton as defined in claim 1 having two of said bottom closure straps and associated hangers, said carton thereby having contents-viewing openings in the front and rear walls thereof, with both of said bottom closure straps laying in a common plane.

8. A folding carton as defined in claim 1 wherein said closure strap is of a width greater than the width of said hangers.

9. A folding carton as defined in claim 1 wherein an upper corner formed by the joinder of two of said vertical walls is removed to provide an opening for viewing a portion of the contents contained within the carton.

10. A folding carton as defined in claim 1 wherein said closure strap is formed by removing a portion of said first wall at a position elevated above the bottom of said first wall.

11. A folding carton as defined in claim 10 wherein said closure strap in an erected condition is positioned a horizontal distance from the bottom of said first wall equal to the vertical distance between the bottom of said first wall and the portion removed therefrom in forming said closure strap.

12. A folding carton as defined in claim 10 wherein said closure strap in an erected condition is spaced from said first wall a distance determined by the length of said strap hangers formed from a vertical wall of said carton.

13. A paperboard blank adapted, when assembled and erected, to form a paperboard carton, said blank comprising, in combination, four wall-forming panels lying respectively adjacent one another and each joined to its adjacent panel along a fold line, at least one of said four wall-forming panels hhaving a portion contiguous with the margin removed to facilitate internesting of carton blanks, a securing flap connected by a fold line to one of said wall-forming panels and forming one end of said carton blank, a pair of top forming closure flaps each joined to a wall-forming panel for forming a top closure for said carton, said pair of top forming closure flaps joined to a wall-forming panel being of a reduced width in relation to the width of said wall-forming panels and having one pair of flap edges thereof which lie parallel to and closely adjacent one of said carton wall-forming panels and another pair of edges lying parallel to but spaced from an oppositely disposed carton wall-forming panel to provide an opening for viewing the contents of said carton, said pair of wall-forming panels to which said top-forming closure flaps are joined being separated from each other by another wall-forming panel, said top forming closure flaps being attached to their associated wall-forming panels along fold lines and having mutually cooperating means for engagement to form a locking end closure, a bottom closure-strap forming portion of said blank defined by parallel cut lines extending the entire width of one wall-forming panel, and a pair of strap-hanger forming portions of said blank, said strap-hanger forming portions comprising first and second pairs of parallel cut lines disposed on either side of said pair of strap-forming cut lines, said pair of hanger-forming cut lines being of unequal length and each pair joined at one of their respective ends by a diagonally extending fold line.

14. A paperboard blank as defined in claim 13 wherein said pair of top forming closure flaps joined to said wall-forming panels are formed from at least a portion of said wall-forming panels removed from a separate internested carton blank.

15. A paperboard blank as defined in claim 14 wherein said pair of top forming closure flaps of one carton blank extend the entire depth of the removed portion of a separate internested carton blank to substantially eliminate paperboard waste and maximize paperboard blank use.

16. A paperboard sheet having arranged thereon at least one pair of carton paperboard blanks, each of said blanks being identical to the other and each comprising, in combination, one front, one rear, and two sidewall forming panels, means for fastening two adjacent wall panels to each other in the erect condition of said carton, said wall-forming panel portions being respectively attached to one another along fold lines extending transversely of said blank, a pair of spaced apart, parallel cut lines lying parallel to a longitudinal edge of said blank and extending from one side wall-forming panel, through the front wall forming panel, and into the other adjacent sidewall panel, said cut lines being of unequal length and being joined to each other at their respective ends by a pair of diagonally extending fold lines, said blank also having a pair of edge portions respectively defining cut-outs in at least portions of two of said sidewall forming panels for defining, in the erected condition of the blank, a pair of sidewall openings extending downwardly from the upper edges of said carton, said blank also including a pair of closure-forming flaps joined to a pair of wall forming panels which are spaced apart from each other by an intermediate wall panel for forming a top closure for said carton including top cover-forming flaps associated with said wall-forming panels of a reduced width in relation to the width of said wall-forming panels, and having one pair of flap edges thereof which lie parallel to and closely adjacent one of said carton wall-forming panels and another pair of flap edges lying parallel to but spaced from an oppositely disposed carton wall-forming panel to provide an opening for viewing the contents of said carton, said flaps including locking means thereon and being attached to their associated wall portions by fold lines, said blanks being arranged on said sheet in said pairs such that the closure-forming flaps of one blank extend into the opening-defining portions of the adjacent blank in nested relation, and so that the edges of said respective blanks which will form the top edges of said cartons in the erected position lie along a common cut line defining at least a portion of the longitudinal edge of each of said blanks.

* * * * *